US009443677B2

(12) United States Patent
Richards et al.

(10) Patent No.: US 9,443,677 B2
(45) Date of Patent: Sep. 13, 2016

(54) FLEXIBLE ROTARY CONTROL

(71) Applicant: MOTOROLA SOLUTIONS, INC, Schaumburg, IL (US)

(72) Inventors: Scott H Richards, Plantation, FL (US); Ryan M Nilsen, Pompano Beach, FL (US); Craig F Siddoway, Davie, FL (US); Chi T Tran, Weston, FL (US)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 184 days.

(21) Appl. No.: 14/083,019

(22) Filed: Nov. 18, 2013

(65) Prior Publication Data

US 2015/0136574 A1 May 21, 2015

(51) Int. Cl.
*H01H 19/14* (2006.01)

(52) U.S. Cl.
CPC ..... *H01H 19/14* (2013.01); *H01H 2217/008* (2013.01); *H01H 2221/01* (2013.01); *H01H 2221/024* (2013.01); *H01H 2231/036* (2013.01); *H01H 2239/03* (2013.01)

(58) Field of Classification Search
CPC ..... H01H 19/14; H01H 2217/008; H01H 2239/03; H01H 2221/024; H01H 2231/036; H01H 2221/01
USPC ..... 200/336, 308, 316, 314, 340, 296
See application file for complete search history.

(56) References Cited

U.S. PATENT DOCUMENTS

| | | | | |
|---|---|---|---|---|
| 4,131,033 | A | 12/1978 | Wright et al. | |
| 4,196,691 | A | 4/1980 | Imazeki | |
| 4,392,256 | A | 7/1983 | Russell | |
| 4,437,840 | A | 3/1984 | Filippos | |
| 5,984,232 | A | 11/1999 | Delorio, Jr. | |
| 6,138,362 | A | 10/2000 | Yoshimori | |
| 7,412,772 | B1 | 8/2008 | Khoshnood | |
| 8,029,531 | B2 | 10/2011 | Lee et al. | |
| 8,173,923 | B2 * | 5/2012 | Lee | B60K 37/06 200/543 |
| 8,766,116 | B2 * | 7/2014 | Barrena | F23N 1/007 200/17 R |
| 8,907,240 | B2 * | 12/2014 | Kosaka | H01H 25/065 200/400 |
| 2007/0151114 | A1 | 7/2007 | Papp et al. | |
| 2007/0152988 | A1 | 7/2007 | Levin et al. | |
| 2010/0228235 | A1 | 9/2010 | Lee et al. | |
| 2013/0150833 | A1 | 6/2013 | Peine et al. | |

FOREIGN PATENT DOCUMENTS

| | | | |
|---|---|---|---|
| CN | 2135129 | Y | 6/1993 |
| GB | 2216327 | A | 10/1989 |

OTHER PUBLICATIONS

Corresponding PCT Application No. PCT/US2014/063978—International Search Report, mailing date Feb. 4, 2015—10 pp.

* cited by examiner

*Primary Examiner* — Edwin A. Leon
(74) *Attorney, Agent, or Firm* — Barbara R. Doutre

(57) ABSTRACT

A rotary control knob (110) for a portable radio (100) utilizes a flexible shaft (112) as a tether to provide a plurality of flexible positions. The flexible shaft (112) is coupled to a switch mechanism (116) located in the radio housing (102). The rotary control knob (110) can be slid up and down the flexible shaft (112) and the flexible shaft can be bent to provide improved user access to the knob, such as for gloved usage.

22 Claims, 7 Drawing Sheets

FLEXIBLE ROTARY CONTROL

FIELD OF THE DISCLOSURE

The present invention relates to rotary controls, and more particularly to rotary controls used in communication devices having limited space.

BACKGROUND

Portable communication devices, such as two-way radios, and associated radio accessories typically utilize rotary controls for controlling radio functionality. For example rotary knobs provide a user interface for such features as volume, channel change, and the like. Within the public safety environment, traditional rotary controls utilize a rigid shaft mounted on a control surface of the portable radio. However, these rigid shaft mounted knobs may be susceptible to inadvertent actuation. Clothing and other surfaces may contribute to inadvertent actuation. For example, gloved operation of a rotary control may inadvertently actuate another nearby rotary control. When a portable radio is worn inside clothing, such as a police vest or turncoat, the radio control knobs may not be readily accessible. Space constraints associated with portable radios also pose a concern in that close, fixed proximity rigid controls on a radio control top may compromise access and usability. Fixed rotary controls may also be subject to damage upon impact when dropped.

Accordingly, it would be desirable to have an improved rotary control for a portable communication device.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1A:
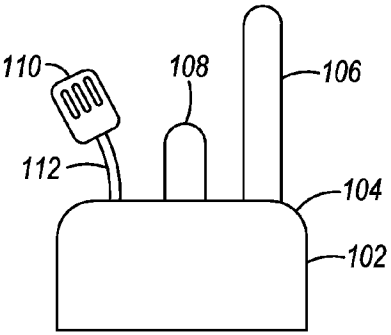
FIGS. 1A-1E show a portable radio having a rotary control knob formed and operating in accordance with the various embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein an improved rotary control knob for portable communication device. The rotary control knob is coupled to a switch shaft via a flexible cable that can be grasped and twisted by a user. The flexible cable allows the knob to deflect when coming in contact with another object.

FIG. 1A-1E shows a portable radio 100 having a rotary control knob formed and operating in accordance with the various embodiments. FIG. 1A shows the portable radio 100 comprising a housing 102 having a control surface 104 upon which are situated a plurality of radio elements, for example an antenna 106, a first control knob 108 and a second control knob 110. Second control knob will be referred to as rotary control knob 110 which is formed and operating in accordance with the various embodiments. Rotary control knob 110 is extended away from the housing 102 via a flexible shaft 112 of a predetermined length. The use of the flexible shaft 112 provides a tether which allows the rotary control knob 110 to rotate freely, over a variety of user selectable positions, as opposed to past fixed controls.

Figure 1B:
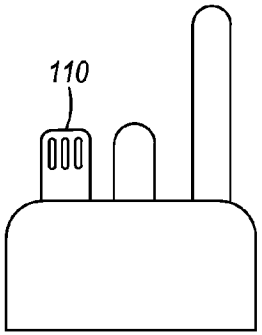

FIG. 1B shows the rotary control knob 110 slid back against the control surface 104 of the housing 102, wherein the flexible shaft is concealed within the knob. Thus, no separate piece parts need to be adjusted by the user. Whether the rotary control knob 110 is extended to the end of the flexible shaft 112, as in FIG. 1A, or retracted to the base of the shaft, as in FIG. 1B, the flexibility of the flexible shaft 112 provides additional protection against breakage if the portable radio 100 is dropped.

Figure 1C:
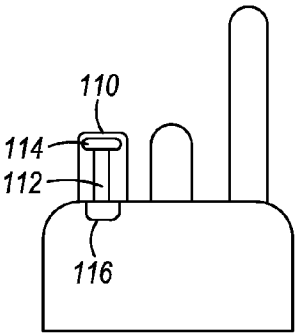

FIG. 1C shows a cross sectional view of the rotary control knob 110 having the flexible shaft 112 and a catch 114 located inside a cavity of the knob 110. A rotational switch mechanism 116, known in the art, is coupled within the housing 102. In accordance with the various embodiments, the flexible shaft 112 is coupled to the switch mechanism 116. The flexible shaft 112 may be coupled to the switch mechanism 116 via an adaptor which is crimped or swaged to the cable itself or other known attachment means. The catch 114 is coupled to one end of the flexible shaft 112 and remains within a cavity inside the knob 110. For example, the catch 114 may be crimped or swaged to the upper end of the flexible cable assembly.

Figure 1D:
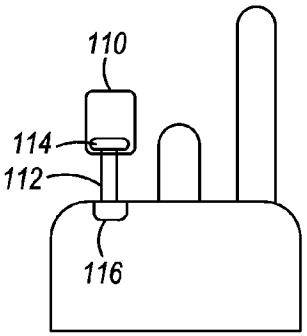
Figure 1E:
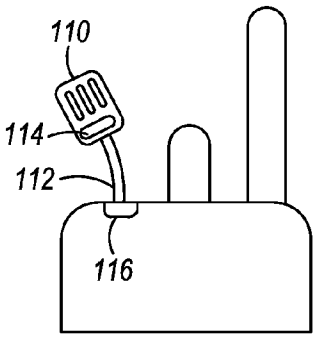

FIG. 1D shows a cross sectional view of the rotary control knob 110 slid up the flexible shaft 112, retained by the catch 114 in a tethered position. Hence, the catch 114 retains the knob 110 when the knob is extended away from the housing 102 along the flexible shaft 112. In accordance with the various embodiments, in response to rotation of the rotary control knob 110, the flexible shaft 112 rotates thereby rotating the switch mechanism 116. The flexible shaft 112 provides a mechanical user interface. Any electrical control associated with the switch mechanism 116 remains within the radio, thereby protecting it against environmental elements. FIG. 1E shows an example of a user selected position for the flexible shaft 112 and rotary control knob 110. Here again, the knob 110 can be rotated and the rotational movement will be transferred from one end of the shaft to the other to rotate the switch mechanism 116.

Figure 2B:
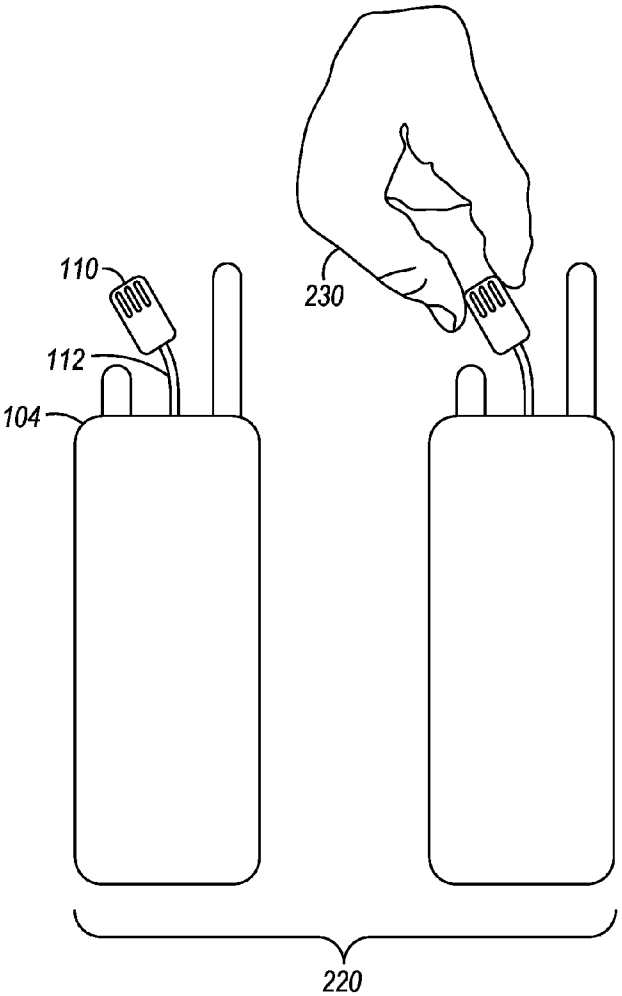
FIGS. 2A-2B show a comparison between user interfaces associated with the rotary control knob in accordance with the various embodiments.
Figure 2A:
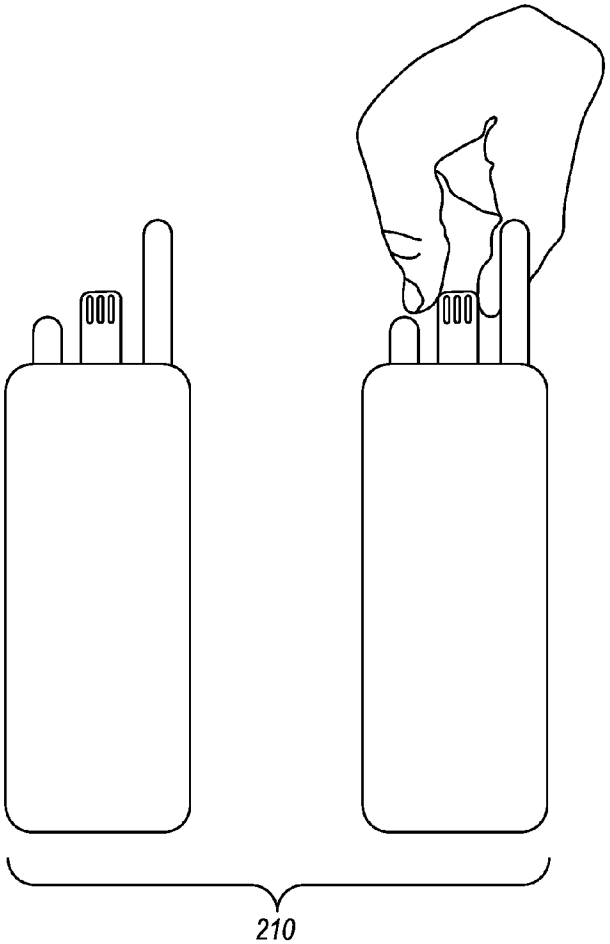

FIGS. 2A-2B show a comparison between user interfaces provided with the rotary control knob not being extended at view 210 and being extended at view 220, respectively. Having the rotary control knob 110 slid to the end of the flexible shaft 112, as shown in FIG. 2B provides more access for a user 230 to manipulate the knob. Rotations of the knob 110 are along the flexible shaft 112. The flexible shaft 112 provides user selectable positioning of the rotary control knob 110. For example, view 220 of FIG. 2B. shows how the flexible shaft 112 can be angled at a non 90 degree angle with respect to the portable radio's control surface 104.

Figure 3A:
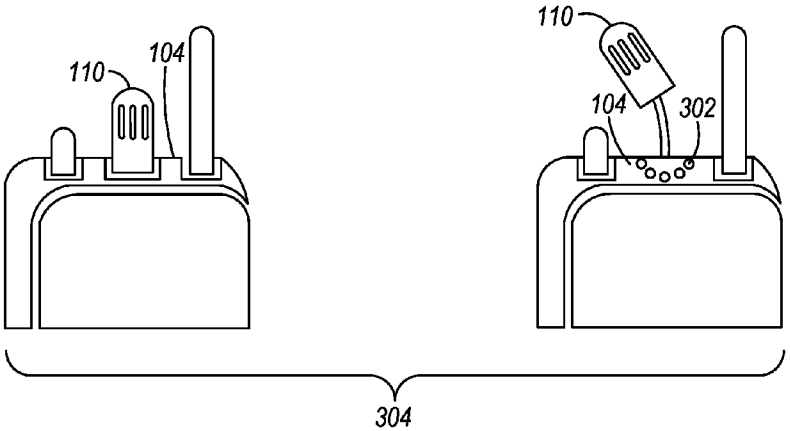
FIGS. 3A-3B show various control knob configurations to facilitate control congestion on a control surface of a portable radio in accordance with the various embodiments.
Figure 3B:
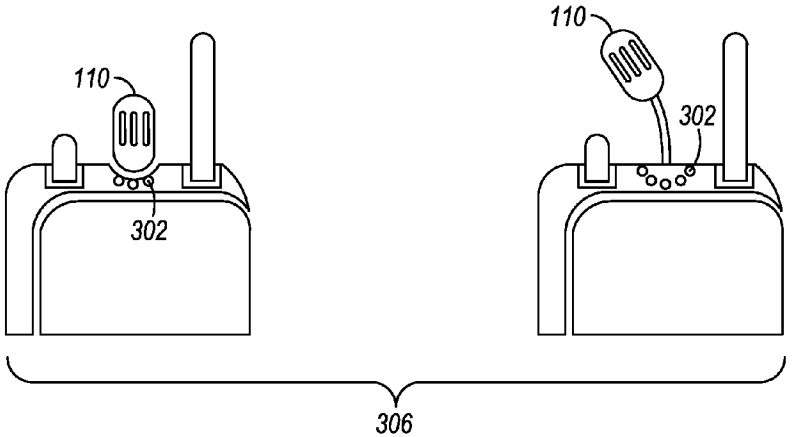

FIGS. 3A and 3B show various control knob configurations to facilitate control congestion on a control surface of a portable radio in accordance with the various embodiments. Graphical labeling information 302 pertaining to the control knob 110 can be disposed on the radio housing control surface 104 beneath the rotary control knob 110. FIG. 3A shows a view 304 that embodies rotary control knob 110 as a flat bottom knob. The control knob 110 can be tilted to reveal the graphics. FIG. 3B shows a view 306 that embodies rotary control knob 110 as a tapered knob which can also be used so that the graphics can be placed in close proximity to the knob. In both the extended and non-extended positions of view 306, the graphics 302 can be seen. Thus, the various embodiments of the rotary control knob 110 facilitate the placement of graphics closer in proximity to the knob than graphics used in past traditional knob interfaces. The rotary control knob 110 is thus advantageous over past static type knobs on the control surface which required the graphics to be outside the diameter of the knob taking up additional space on the radio control surface.

Figure 4B:
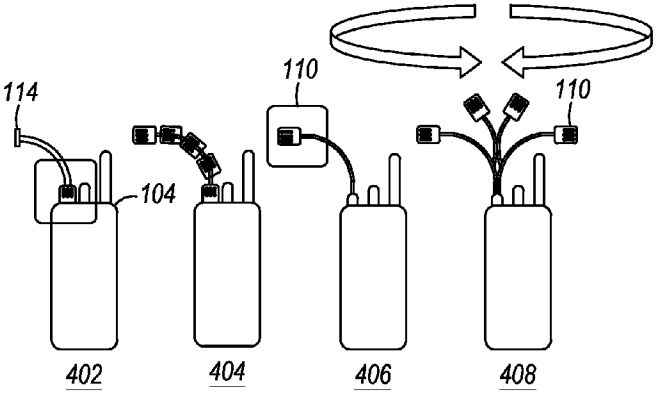
FIG. 4A-4C show a user selectable tether length for the rotary control knob in accordance with the various embodiments.
Figure 4C:
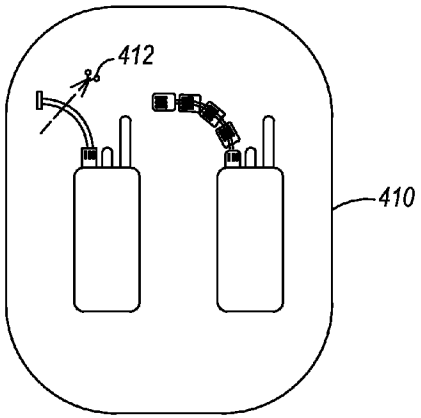
Figure 4A:
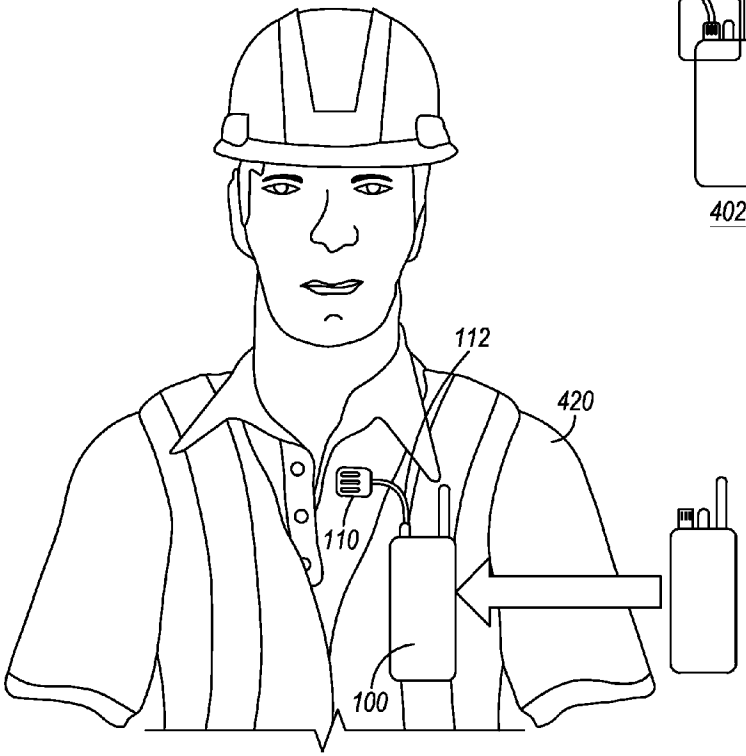

FIG. 4A-4C show embodiments depicting a user selectable tether length for the rotary control knob 110 in accordance with the various embodiments. Since the flexible shaft 112 is formed of a semi rigid material, a user 420, such as shown in FIG. 4A, may position the knob 110 anywhere along the tether 112. In an embodiment shown in FIG. 4B, the flexible shaft 112 can extend through the rotary control knob 110 at view 402, and the knob 110 can be slid toward catch 114 at view 404. View 406 shows the knob slid to the very end of the flexible shaft 112, which provides for a plurality of tilting configurations at 408. The control is still rotary but is located at the end of the flexible shaft. In FIG. 4C, in another embodiment 410, the desired length of tether can be selected by the user, and the remaining flexible cable can be cut off 412 and discarded. Thus, the flexible shaft 112 and rotary control knob 110 can be used to provide a user adjustable length which is not limited by the size of the knob. The use of the flexible shaft 112 also allows for the shaft to be bent into a variety user selectable positions.

Figure 5A:
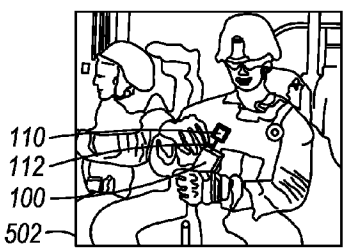
FIGS. 5A-5D show a variety of use case examples for a portable radio incorporating the rotary control knob formed and operating in accordance with the various embodiments.
Figure 5B:
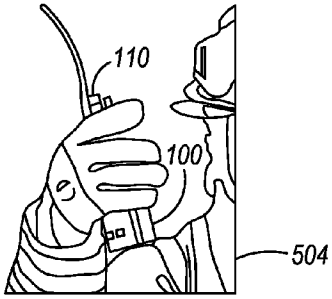
Figure 5C:
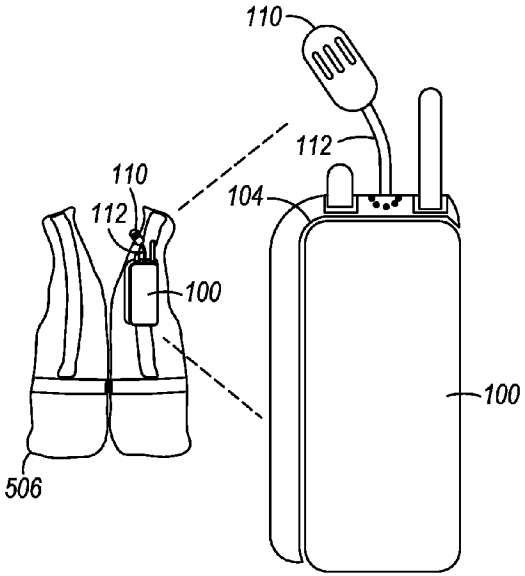
Figure 5D:
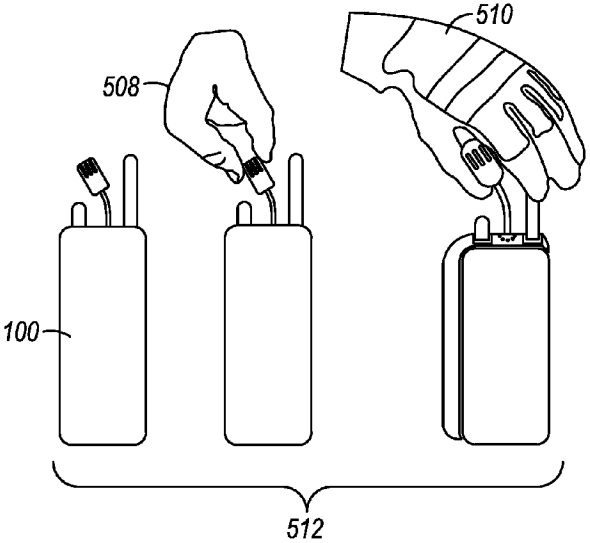

FIGS. 5A-5D show a variety of use case examples for the portable radio 100 incorporating the rotary control knob 110 formed and operating in accordance with the various embodiments. FIG. 5A showing scenario 502 illustrates the portable radio 100 having the rotary control knob 110 tethered by flexible shaft 112 being used in a military environment. FIG. 5B showing scenario 504 illustrates a fire rescue environment wherein the tether is located back within the knob 110 of portable radio 100. Another scenario in FIG. 5C shows a police vest 506 with portable radio 100 attached thereto, the rotary control knob 110 is tethered via flexible shaft 112. This scenario shows how the flexible shaft 112 can be angled at a non-90 degree angle with respect to the portable radio's control surface 104. The non-90 degree angle positioning can be advantageous for both free hand operation 508 and gloved hand operation 510 as shown in scenario 512 shown in FIG. 5D. Hence, the flexible shaft 112 provides user selectable positioning of the rotary control knob 110.

Figure 6C:
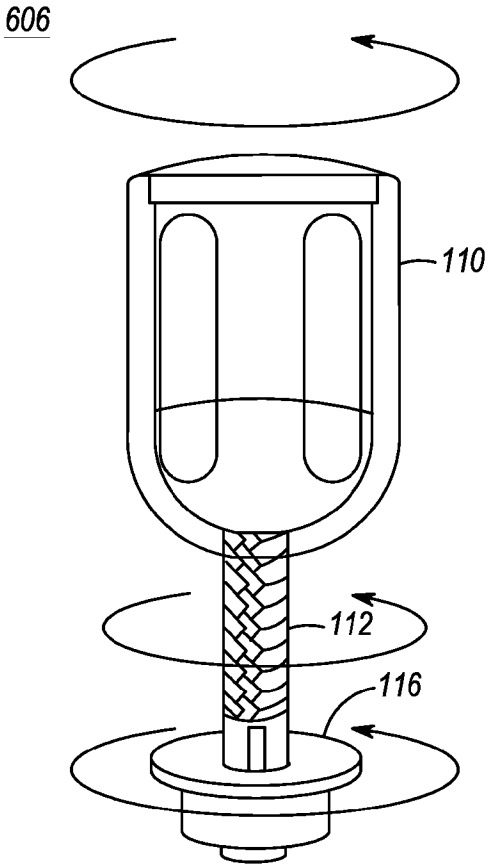
FIGS. 6A-6C show the rotary control knob and flexible shaft in accordance with the various embodiments.
Figure 6B:
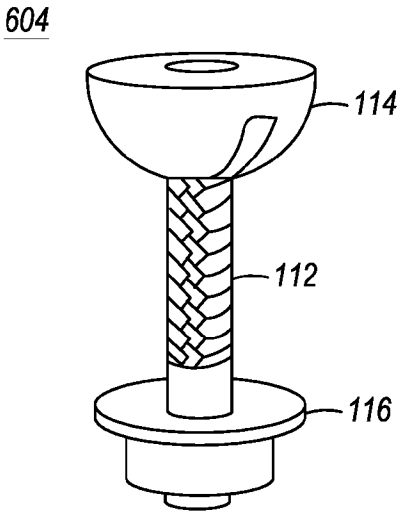
Figure 6A:
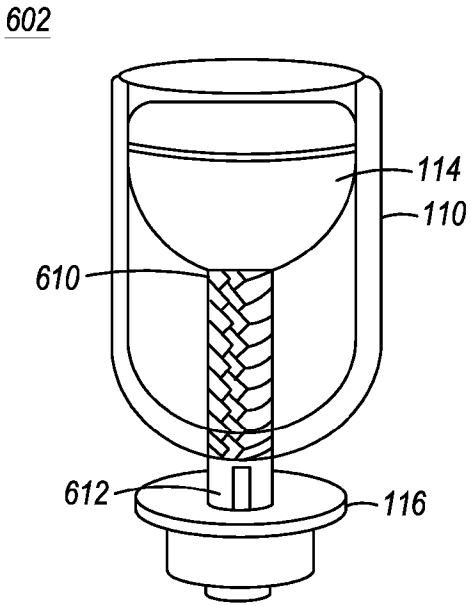

FIGS. 6A-6C show the rotary control knob and flexible shaft in accordance with the various embodiments. FIG. 6A shows a cross sectional view 602 of the rotary control knob 110 slid over the flexible shaft 112. The flexible shaft 112 may be formed of a semi rigid cable, such as steel braided aircraft cable or a tightly coiled spring (commonly referred to as speedometer cable). As shown in FIGS. 6A and 6B with views 602 and 604, the flexible shaft 112 has a first end 610 coupled the catch 114 and a second end 612 coupled to the switch mechanism 116. As shown in FIG. 6A, the catch 114 is located within the rotary control knob 110. As shown in FIG. 6C with view 606, the rotary control knob 110 is slid upward along the flexible shaft 112 where the catch catches and retains the rotary control knob. Again, the catch 114 is used to retain the knob 110 when the knob is extended away from the radio housing along the flexible shaft 112. As shown in view 606 of FIG. 6C, the shaft positioned straight out from the control top surface, which is an angle of approximately 90 degrees relative to the surface of the radio. As the rotary control knob 110 is turned, the shaft 112 turns, which thereby turns the switch mechanism 116, as the rotational motion of the knob 110 is transferred along the angled shaft 112 to the rotational switch mechanism 116.

Figures 7A, 7B, 7C:
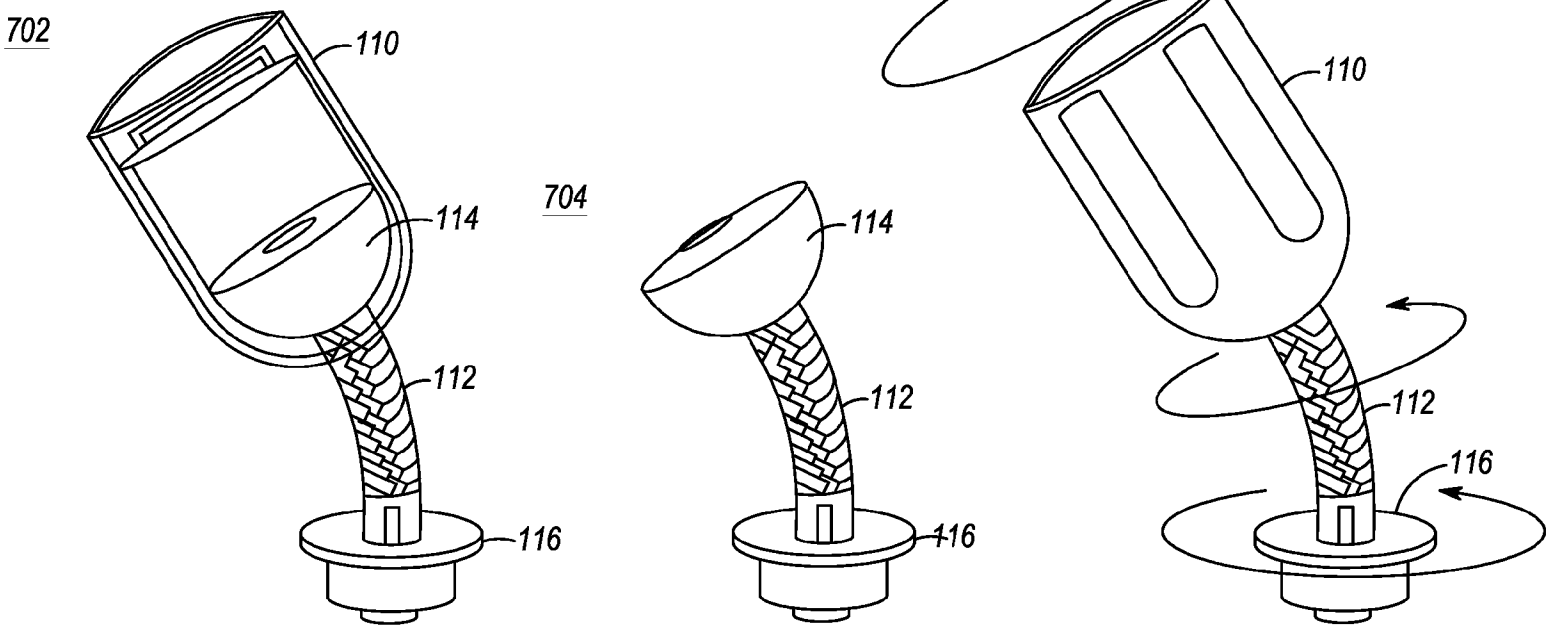
FIGS. 7A-7C show the rotary control knob and flexible shaft in different flexed positions in accordance with the various embodiments.

FIGS. 7A-7C show the rotary control knob and flexible shaft in different flexed positions accordance with the various embodiments. A cross sectional view 602 shows rotary control knob 110 slid upwards along the flexible shaft 112 with catch 114 located inside the base of the knob. Again, the flexible shaft 112 may comprise a semi rigid cable, such as steel braided aircraft cable or a tightly coiled spring (commonly referred to as speedometer cable). As shown in FIGS. 7A and 7B with views 702 and 704, the flexible shaft 112 allows for bending the shaft to a user-selectable desired position. As shown in FIG. 7C view 706, even at an angled position, as the rotary control knob 110 is turned, the shaft 112 turns, which thereby turns the switch mechanism 116. The rotational motion is transferred along the angled shaft 112 to the rotational switch mechanism 116.

Accordingly, there has been provided an improved rotary control with flexible features for a customized user interface A portable radio incorporating the rotary control knob of the various embodiments can be tethered in an extended position away from the control top surface to provide sufficient space for gloved usage. Whether the rotary control knob is extended to the end of the shaft, retracted to the base of the shaft, or anywhere in between, the flexibility of the flexible shaft advantageously provides additional protection against breakage if the radio is dropped. Graphics associated with the control knob can be placed closer to the knob, or even under the knob, if the rotary control is going to be used in an extended position, away for the control surface of the radio. Unlike past devices where the knob is static on the control surface which forces the graphics to be outside the diameter of the knob requiring additional space, the tether rotary control knob of the various embodiments allows graphics within or under the knob footprint. A tapered knob also allows graphics to be placed in closer proximity to the knob, providing visibility to the graphics in both extended and retracted knob positions.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises" . . . a "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A portable radio, comprising:

a housing;

a rotary control knob;

a flexible shaft having a first end with a catch, the catch being located within the rotary control knob, wherein the rotary control knob slides up and down the flexible shaft; and a switch mechanism located within the housing, the switch mechanism coupled to a second end of the flexible shaft.

2. A portable radio, comprising:

a housing;

a rotary control knob;

a flexible shaft having a first end with a catch, the catch being located within the rotary control knob, wherein the flexible shaft is located inside the rotary control knob when the rotary control knob is slid against the housing; and a switch mechanism located within the housing, the switch mechanism coupled to a second end of the flexible shaft.

3. The portable radio of claim 1, wherein flexible shaft provides a tether for the rotary control knob when the rotary control knob is extended away from the housing.

4. The portable radio of claim 1, wherein flexible shaft provides user selectable positioning of the rotary control knob.

5. The portable radio of claim 1, wherein flexible shaft comprises a semi rigid cable.

6. The portable radio of claim 1, wherein the catch retains the rotary control knob when the rotary control knob is extended away from the housing along the flexible shaft.

7. The portable radio of claim 1, further comprising:

a graphical interface disposed on the housing beneath the rotary control knob.

8. The portable radio of claim 1, wherein the rotary control knob comprises a knob with tapered bottom.

9. The portable radio of claim 1, wherein the rotary control knob comprises a knob with a flat bottom.

10. The portable radio of claim 1, wherein the flexible shaft extends through the rotary control knob to provide a user selectable adjustable length.

11. The portable radio of claim 10, wherein the user selectable adjustable length is set by cutting the flexible shaft.

12. The portable radio of claim 10, wherein the user selectable adjustable length is set by positioning the rotary control knob along different locations of the flexible shaft.

13. A portable radio, comprising:

a housing; and a rotary control knob tethered to the housing via a flexible shaft, the flexible shaft being coupled to a switch mechanism within the housing, wherein the flexible shaft is located within the rotary control knob when the rotary control knob is in a retracted knob position against the housing, and the flexible shaft is located between the rotary control knob and the housing when the rotary control knob is extended away from the housing.

14. The portable radio of claim 13, wherein rotation of the rotary control knob transfers rotational motion through the flexible shaft to the switch mechanism.

15. The portable radio of claim 13, wherein the rotary control knob provides volume control of the portable radio.

16. The portable radio of claim 13, wherein the rotary control knob provides channel control of the portable radio.

17. The portable radio of claim 13, wherein the flexible shaft has an adjustable length.

18. The portable radio of claim 13, wherein the rotary control knob being tethered in an extended position away from the housing provides sufficient space for gloved usage.

19. The portable radio of claim 13, wherein the flexible shaft comprises a semi-rigid cable.

20. The portable radio of claim 19, wherein the semi-rigid cable provides a plurality of user-selectable positions.

21. The portable radio of claim 20, wherein the rotary control knob being tethered to the flexible shaft enables the rotary control knob to rotate freely amongst the user-selectable positions.

22. A portable radio, comprising:

a housing;

a rotary control knob;

a flexible shaft having a first end with a catch, the catch being located within the rotary control knob, the rotary control knob being tethered to the flexible shaft thereby enabling the rotary control knob to rotate freely amongst user-selectable positions; and a switch mechanism located within the housing, the switch mechanism being coupled to a second end of the flexible shaft.

* * * * *